US005431286A

United States Patent [19]

Xu et al.

[11] Patent Number: 5,431,286

[45] Date of Patent: Jul. 11, 1995

[54] RECIRCULATING COLUMN FLOTATION APPARATUS

[75] Inventors: Manqiu Xu, Oakville; Jeff McLaughlin, Hanmer; Peter Quinn, Oakville; Ric Stratton-Crawley, Burlington, all of Canada

[73] Assignee: Inco Limited, Toronto, Canada

[21] Appl. No.: 177,894

[22] Filed: Jan. 6, 1994

[51] Int. Cl.[6] ..... B03D 1/24; B01F 3/04

[52] U.S. Cl. ..... 209/170; 209/168; 261/122.1; 261/123; 261/124; 261/DIG. 75

[58] Field of Search ..... 209/170, 169, 168; 210/221.2; 261/122.1, 123, 124, DIG. 75

[56] References Cited

U.S. PATENT DOCUMENTS

| | | | |
|---|---|---|---|
| 2,695,710 | 11/1954 | Gibbs . | |
| 2,778,499 | 1/1957 | Chamberlain . | |
| 3,256,802 | 6/1966 | Kerr . | |
| 3,342,331 | 9/1967 | Maxwell . | |
| 3,545,731 | 12/1970 | McManus . | |
| 3,802,569 | 4/1974 | Nagahama . | |
| 4,448,681 | 5/1984 | Ludke . | |
| 4,655,915 | 4/1987 | Carpinone . | |
| 5,078,921 | 1/1992 | Zipperian | 261/122 |
| 5,096,572 | 3/1992 | Hwang | 209/164 |
| 5,133,906 | 7/1992 | Louis . | |
| 5,167,798 | 12/1992 | Yoon et al. | 209/170 |
| 5,188,726 | 2/1993 | Jameson . | |
| 5,282,538 | 2/1994 | Moys . | |

FOREIGN PATENT DOCUMENTS

| | | |
|---|---|---|
| 1053388 | 4/1979 | Canada . |
| 3606747 | 9/1987 | Germany . |
| 91/1809 | 2/1991 | WIPO . |

OTHER PUBLICATIONS

C. E. Jordan and F. J. Susko, "Rapid Flotation Using a Modified Bubble-Injected Hydrocyclone and a Shallow-Depth Froth Separatory For Improved Flotation Kinetics", Minerals Engineering, vol. 5, Nos. 10–12, pp. 1239–1257, 1992.

R. H. Yoon, G. H. Luttrell, G. T. Adel and M. J. Mankosa, "The Application of Microcel TM Column Flotation to Fine Coal and Mineral Processing", pp. 1–21, date unknown.

*Primary Examiner*—Thomas M. Lithgow
*Attorney, Agent, or Firm*—Edward A. Steen

[57] ABSTRACT

A column flotation system including tailings recirculation. The system includes a column for particle separation and a gas injected reactor providing the site for bubble generation within a treated slurry feed. The reactor may contain a plurality of the spaced internal discs that cause shearing of the slurry to generate and entrain bubbles therein. The column may contain internal partitions in order to accommodate additional reactors. Recirculation of the tailings permits increased bubble control and improved particle separation.

7 Claims, 3 Drawing Sheets

RECIRCULATING COLUMN FLOTATION APPARATUS

TECHNICAL FIELD

The instant invention relates to froth flotation in general and more particularly to an efficient flotation column that has higher flotation kinetics and is decidedly shorter than current column designs.

BACKGROUND ART

Froth flotation is a well known metallurgical technique for beneficiating various mineral ores and separating their components for subsequent recovery or disposal. An aqueous pulp is inundated with gas bubbles. By judicious additions of frothers and surfactants, the hydrophobic and hydrophilic natures of the particles comprising the pulp are enhanced to effect separation. Normally, a fraction of the conditioned pulp with hydrophobic particles will tend to float. These particles may be skimmed off the top and routed for subsequent processing. Similarly, the hydrophilic particles tend to remain in the pulp. These latter particles can then be discharged for subsequent processing.

Of the various froth flotation systems currently in use, column flotation tends to give superior metallurgical results, particularly, better concentrate grade due to the wash water addition at the top of column. A gas, usually air, is introduced through spargers at the bottom of the column to generate bubbles therein.

Particle collection by bubbles in a conventional flotation column is considered to occur by bubble/particle encounter mechanisms in which hydrophobic particles collide with and subsequently attach to bubbles. Particles attached to bubbles will rise to the column top and will overflow as concentrate. The hydropholic particles that collide with but do not adhere to the bubbles will descend to the column bottom and be discharged as tailings. Some flotation column designs utilize mechanical mixers disposed in the column to effect separation. However, to optimize the flotation process in columns, the bubbles must flow at a minimum flow velocity since relatively quiescent conditions are required.

The success in column flotation has led to many new developments. Among these new developments, the Jameson TM cell and the Microcel TM column are considered to be superior than the conventional columns. There is a common point in these two types of columns: pulp aeration before entering column. In the Microcel column, air is introduced using an in-line static mixer. This eliminates the problems inherently associated with the conventional internal air spargers. The column itself is identical to the conventional column: 10–12 m in length and 1–2 m froth zone. In the Jameson cell, air is aspirated into a pipe called a downcomer using a high-velocity feed slurry jet at the top. There are some problems with the aeration device in the Jameson cell. Finally, the work at the U.S. Bureau of Mines shows that direct contacting between newly formed bubbles and particles improved flotation kinetics by as much as 10 times compared to aged bubbles.

SUMMARY OF THE INVENTION

Accordingly, there is provided a flotation column consisting of a reactor and a separator. Tailings are recycled back into the reactor and combined with fresh feed for bubble control. The reactor is a bubble/particle contacting device where collection takes place while bubbles are being formed. The separator is a quiescent bubble pulp separation column where the hydrodynamics favors the separation of bubble particle aggregates from the pulp with essentially little or no turbulence. The benefits of the instant flotation system are increased particle collection rates and a reduced column height in comparison to conventional columns.

PREFERRED MODE FOR CARRYING OUT THE INVENTION

Figure 1:
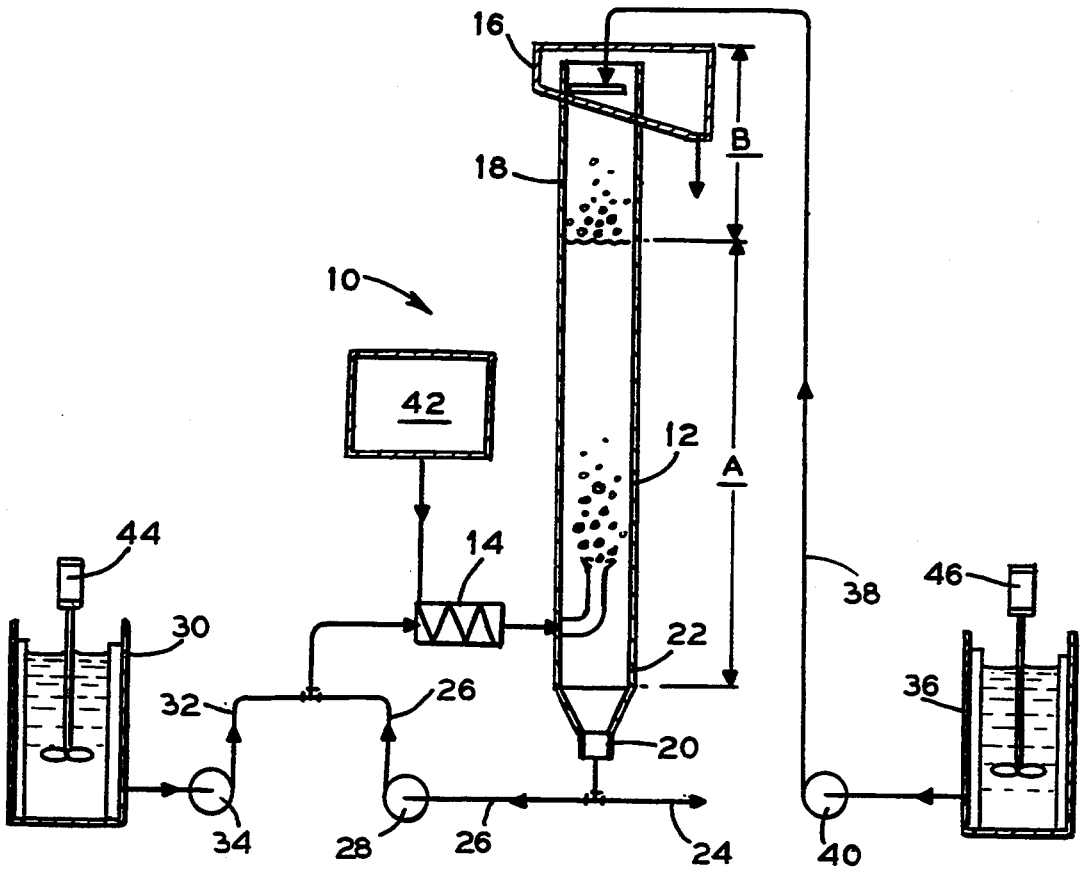
FIG. 1 is a schematic diagram of an embodiment of the invention.

FIG. 1 schematically depicts a feed line aerated flotation column system 10. The system 10 includes a cylindrical column 12 and a reactor 14 connected thereto. An outlet hood 16 is affixed to the upper portion 18 of the column 12. An outlet 20 is disposed at the lower portion 22 of the column 12. A tailings conduit 24 and a recirculation conduit 26 are connected to the outlet 20.

The recirculation conduit 26 recycles a portion of the tailings back to the reactor 14 via pump 28.

A feed tank 30 having an internal mixer 44 holds the slurry and introduces it into the reactor 14 through a feed line conduit 32. A pump 34, propels the slurry into the reactor 14.

A source of wash water 36, with an internal mixer 46, is introduced into the column 12 via conduit 38 by the action of pump 40.

A gas, usually air, is supplied to the reactor 14 by source 42. The combined action of the slurry, air, recycled tailings and the physical configuration of the reactor 14 combine to produce a microbubble entrained slurry stream.

"A" represents the separation zone of the column 12. This is the location where the bubbles and their corresponding attached particles rise up through the slurry. In order to promote maximum particle recovery and separation, it is good practice to maintain the slurry in the column 12 in a quiescent state. Increased turbulence will cause hydrophobic particles to detach from the bubbles. Upgrading of collected particles occurs in froth zone "B". Here the bubbles and their attracted particles forming the concentrate flow into the outlet hood 16.

Figure 2:
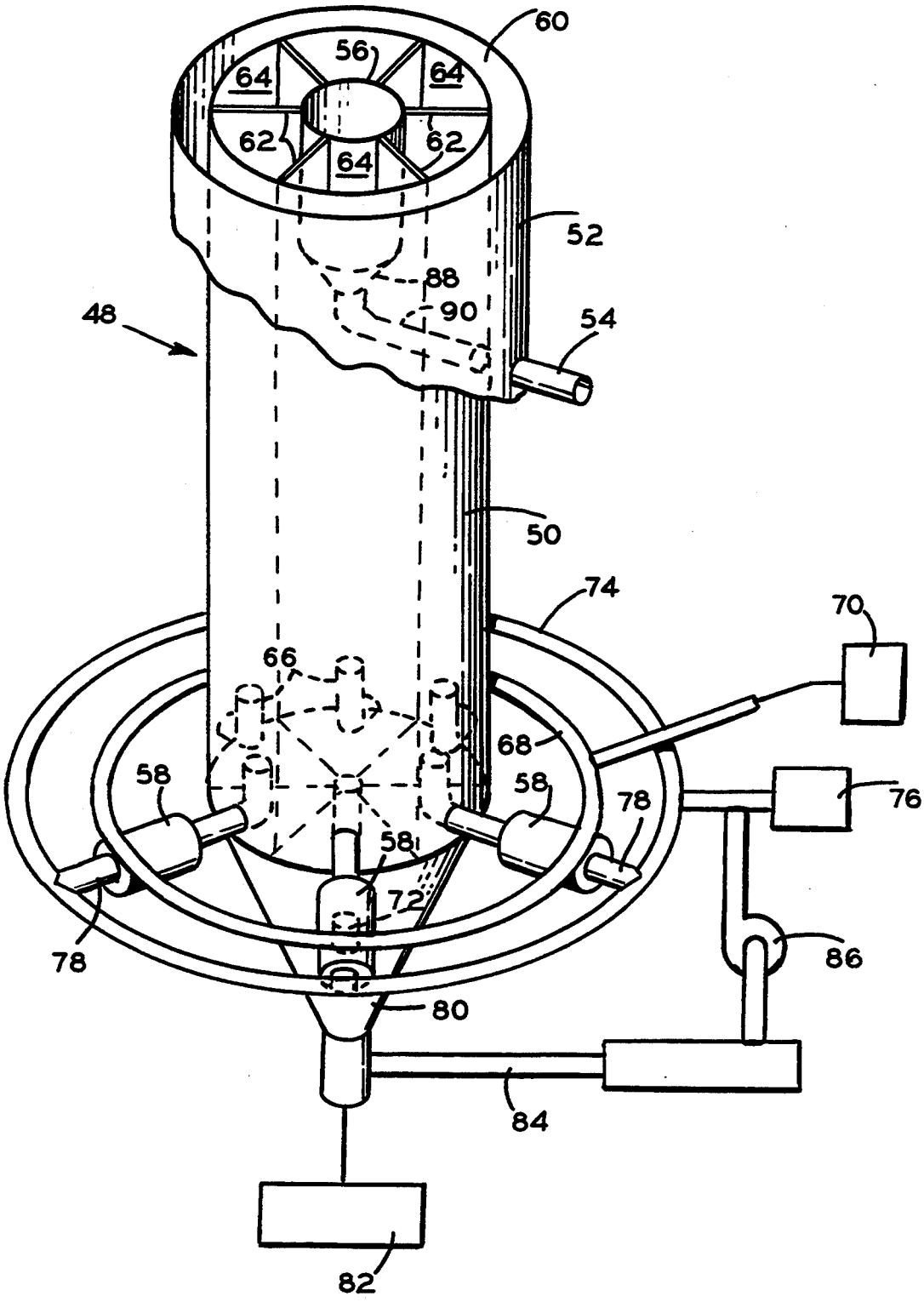
FIG. 2 is a perspective view of an embodiment of the invention.

FIG. 2 depicts a prototype column/reactor system 48 embodying the features of the system 10 in greater detail.

The system 48 includes an upright cylindrical column 50 and a plurality of reactors 58. A concentrate collector hood 52 circumscribes the upper section of the column 50. As the froth bubbles outwardly over the top of the column 50 it flows into an annular space 60 between the hood 52 and the column 50 where it is channeled out through outlet 54. Simultaneously, the froth also overflows inwardly into the tube 56. The tube 56 is connected to a funnel 88 disposed within the column 50. An exit conduit 90 empties out into the annular space 60 so as to allow the froth product in the tube 56 an opportunity to flow through the outlet 54.

A series of partitions 62 extend through the interior of the column 50. The partitions 62 form a matching number of longitudinal separation chambers 64 substantially running the entire length of the column 50.

Disposed towards the bottom of the chambers 64 are inlets 66 connected to the reactors 58. A first header or annular conduit 68, connected to a controllable source of gas 70 provides the gas to the reactors 58 via tubes 72. A second header or annular conduit 74, connected to a controllable slurry feed source 76, introduces the slurry into the reactors 58 via tubes 78.

Funnel 80 channels the bulk of the tailings to repository 82 for subsequent handling and treatment. A portion of the tailings are recirculated back into the reactors 58. Conduit 84 bleeds off a portion of the tailings and propels them through pump 86 into the annular conduit 74 for introduction back into the reactors 58.

The reactor 58 is the site for the turbulent intermixing of the bubbles, the slurry and the recirculated tailings. In order for the column flotation process to operate efficiently, the reactor 58 must cause the formation of microbubbles and aerate the slurry. These bubbles, in turn, attract the appropriate particles in the slurry stream. In order for the intermingling of all of the materials to be accomplished, the reactor 52 must break up the incoming gas stream into small bubbles and then provide the suitable environment for particle collection.

Figure 3:
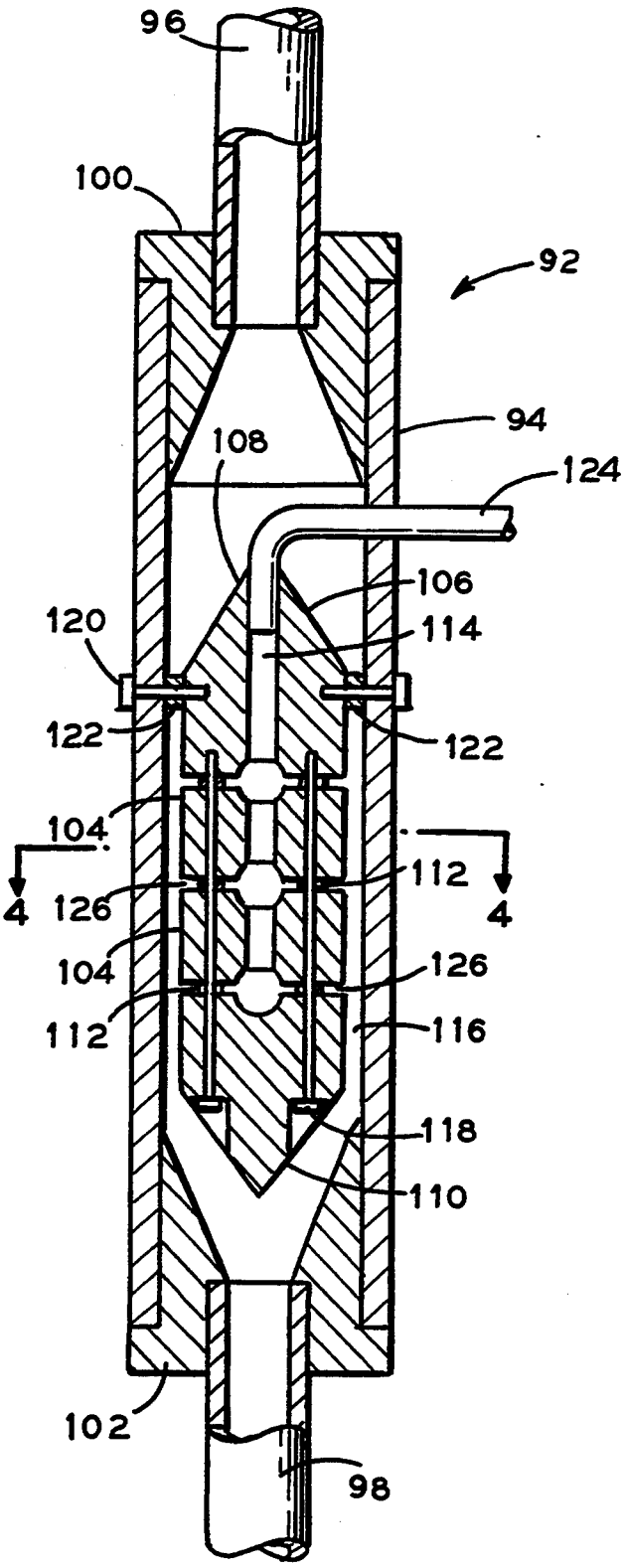
FIG. 3 is a cross-sectional view of an embodiment of the invention.
Figure 4:
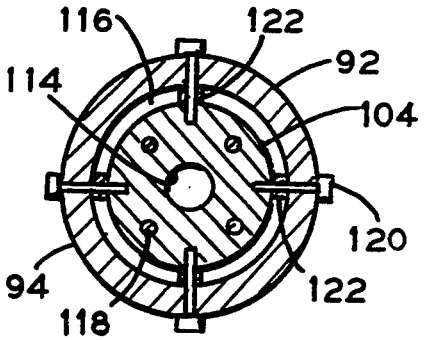
FIG. 4 is a section taken along line 4—4 in FIG. 3.

There are a number of commercially available in-line mixers/reactors. They generally introduce the gas and feed into a tube. The tube contains a number of internal baffles or spirals to create a tortuous flow pattern within the reactor. These devices are acceptable. However, it is preferred to utilize the reactor/aerator shown in FIGS. 3 and 4.

The reactor 92 includes a shell 94, an inlet 96 and an outlet 98 and shaped end plugs 100 and 102. The plugs 100 and 102 are frostoconical opening up into the interior of the shell 94. A bubble generator 106 is disposed within the shell 94. The bubble generator 106 includes a plurality of spaced discs 104 bookended by an extended hollow cone 108 and a solid extended cone 110. The discs 104 are washer-like in shape. As a consequence, the extended hollow cone 108 in conjunction with the discs 104 form an internal channel 114 extending through most of the bubble generator 106.

The cones 108 and 110 and the discs 104 are separated by spacers 112 to form annular voids 126 therebetween. The voids 126 permitting flow access from the internal channel 114 to the annular cavity 116 sandwiched between the shell 94 and the bubble generator 106.

Fasteners 118 extend through the cones 108, 110, the washers 112 and the discs 104 to hold the bubble generator 106 together. Fasteners 120 pass through the shell 94 and spacers 122 to hold the bubble generator 106 in place. A gas inlet tube 124 extends into the internal channel 114.

The gas is routed directly into the internal channel 114 and is forced outwardly through the annular voids 126 into the annular cavity 116. The slurry which includes the recirculating tailings, enters the reactor through inlet 96, flows into the cavity 116 and then out through the outlet 98 and into the column 12. By forcing the gas to essentially make two ninety degree turns and then into the flowing slurry film in the cavity 116, microbubbles are generated and become entrained in the slurry stream. Due to the intense shear forces caused by the high velocity, intense mixing and agitation occur. It is this action that promotes particle collection and causes the formation of the bubble/particle aggregates.

Due to the erosive and/or corrosive nature of the slurry, the reactor 92 components must be selected with care. Example materials include corrosion resistant stainless steel, polymers and ceramics.

A prototype reactor 92 having an effective area of about 0.85 $cm^2$, was successfully built and tested. The overall length of the shell 94 was about 15.0 cm (6 inches) long and about 2.5 cm (1 inch) in overall diameter. The discs 104 were about 2.5 cm (1 inch) tall and about 1.66 cm (0.65 inches) in diameter. The annular voids 126 were about 200 $\mu$m wide and the width of the annular cavity 116 was about 1.2 mm.

In contrast to the violent agitation in the reactor 14, the interior of the column 12 is generally quiescent. The bubbles rise toward the outlet hood 16 carrying with them most of the hydrophic particles.

Tailings recirculation is used to provide an independent means of controlling bubble size. It also permits the secondary collections for the particles that are not collected in the first pass through the system 10. Thus increased collection efficiency may be achieved.

Tests were conducted to determine the efficiency of the flotation system 10. Tailings from Into Limited's Clarabelle mill in Sudbury, Ontario were treated. The target metallurgy was to produce a treated tailings stream containing less than 0.4% sulfur while not exceeding 5% mass reporting to the concentrate.

The experimental set-up was basically the design shown in FIG. 1.

A column 12, 6.35 cm in diameter and 70 cm in height, was initially operated with 6 liters/rain of feed slurry (40% weight by solids) flowrate which gave 11.4 seconds flotation time inside the column. The chemical conditions were pH 7, xanthate was added at 4.5 mg/kg and the frother concentration was maintained 5 mg/l. A concentrate with an average 11.7% sulfur grade was obtained, but the yield was only 1.1% and the tails sulfur grade was only reduced from 0.77% to 0.76%. An extra 50 cm section was added to the column 12, which gave a flotation time of 33.4 seconds and the froth depth was reduced from 25 cm to 5 cm in order to pull more pyrrhotite to the concentrate. A mass recovery of 4.4% was obtained, but the concentrate sulfur grade was substantially lower, at 4.8% and the tailings sulfur content decreased from 0.93% to 0.75%. Reducing the feed flowrate from 6 liters/min to 2 liters/rain and adding a 3 liter/min tailings slurry recirculation, via line 128 and at pH 7, xanthate addition rate 9.1 mg/kg and frother concentration 20 mg/l, resulted in a mass recovery of 6.6% with a concentrate grade 5.9% sulfur. This reduced the tailings sulfur content from 0.75% to 0.4%. It was also found that there was no major mechanical problem with the column 12 operation and no apparent wearing or plugging of the reactor 14.

Test work was also conducted in the laboratory for graphite/chalcopyrite separation of Into Limited's Thompson, Manitoba copper concentrate. The experimental set-up was basically the design shown in FIG. 1. Several important points were observed: (1) the slurry nominal residence time in the reactor 14 was only 0.26 seconds; (2) the slurry nominal residence time in the separation zone 12 with three different heights was, 128 seconds for 125 cm height, 77 seconds for 75 cm and 6 seconds for 6 era; (3) 88% graphite recovery with grade 40% was obtained for the separation zone height 125 cm, up to 80% recovery with similar grade was obtained for the short separation zone height of 6 cm. This result indicates that most of particle collection takes place inside the reactor 14.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A froth flotation system, the system comprising a vertically oriented column divided into an upper froth zone and a lower separation zone, the column including a concentrate collector disposed towards the top of the column, means for withdrawing tailings from the lower portion of the column, means for supplying wash water downwardly into the column from the top of the column, at least one bubble reactor for mixing a slurry with a gas flowably communicating with the separation zone, means for directing the output from the at least one bubble reactor into the column upwardly within the separation zone of the column, a source of slurry and means for flowably communicating the source of slurry with the at least one bubble reactor, a source of gas and means for flowably communicating the source of gas with the at least one bubble reactor, and recycling means for withdrawing a portion of the contents of the column from the lower portion of the column and recycling same to the at least one bubble reactor said column defines a vertical axis and includes a plurality of vertically extending and radially oriented partitions extending from the top of the column and down through the column, said partitions defining a plurality of longitudinal separation chambers disposed between the partitions within the column said means for directing the output from the at least one bubble reactor into the column comprises means for directing the output upwardly inside of each of longitudinal separation chambers.

2. The froth flotation system according to claim 1 wherein said at lest one bubble reactor comprises a plurality of bubble reactors with each bubble reactor corresponding to a single longitudinal separation chamber.

3. The froth flotation system according to claim 1 wherein said means for flowably communicating the source of slurry with the at least one bubble reactor comprises a header conduit communicating with the at least one bubble reactor.

4. The froth flotation system according to claim 2 wherein a central tube is disposed within the froth zone inside the column, the tube supported by the partitions and flowably communicating with the concentrate collector.

5. The froth flotation system according to claim 1 wherein the concentrate collector circumscribes the column.

6. The froth flotation system according to claim 1 wherein the at least one bubble reactor is a microbubble generator, the at least one bubble reactor generating a microbubble entrained slurry and recycled withdrawn portion output for subsequent delivery into the column.

7. The froth flotation system according to claim 1 wherein the at lest one bubble reactor includes a shell having opposing ends and a slurry inlet and outlet means of opposite ends affixed to the shell, said means for flowably communicating the source of gas with the at least one bubble reactor comprises a gas supply conduit entering the interior of the shell, a series of connected, spaced discs disposed within the shell, the discs having a plurality of spaced annular voids therebetween, the voids communicating with the gas supply conduit, a first cone and a second cone, and the discs disposed between the first cone and the second cone, and an annular cavity disposed between the discs and the shell, and the first cone, the second cone and the discs including a central internal channel therein, and the central internal channel communicating with the gas supply conduit and the annular cavity.

* * * * *